US006892045B2

(12) United States Patent
Tokimatsu et al.

(10) Patent No.: US 6,892,045 B2
(45) Date of Patent: May 10, 2005

(54) IMAGE FORMING APPARATUS AND CONVEY CONTROL METHOD FOR RECYCLE TONER

(75) Inventors: Hiroyuki Tokimatsu, Tokyo (JP); Junichi Ohtani, Tokyo (JP)

(73) Assignee: Konica Corporation, Tokyo (JP)

( * ) Notice: Subject to any disclaimer, the term of this patent is extended or adjusted under 35 U.S.C. 154(b) by 14 days.

(21) Appl. No.: 10/439,148

(22) Filed: May 14, 2003

(65) Prior Publication Data

US 2003/0219291 A1 Nov. 27, 2003

(30) Foreign Application Priority Data

May 24, 2002 (JP) ..... 2002-150466

(51) Int. Cl.[7] ..... G03G 21/00
(52) U.S. Cl. ..... 399/359
(58) Field of Search ..... 399/358, 359, 399/360, 260

(56) References Cited

U.S. PATENT DOCUMENTS 5,547,795 A * 8/1996 Ochiai et al.
5,712,072 A * 1/1998 Inaba et al.

FOREIGN PATENT DOCUMENTS

| | | | | |
|---|---|---|---|---|
| JP | 06242681 A | * | 9/1994 | ..... G03G/15/08 |
| JP | 11084977 A | * | 3/1999 | ..... G03G/21/14 |
| JP | 2002162879 A | * | 6/2002 | ..... G03G/21/10 |

* cited by examiner

*Primary Examiner*—Arthur T. Grimley
*Assistant Examiner*—Ryan Gleitz
(74) *Attorney, Agent, or Firm*—Frishauf, Holtz, Goodman & Chick, P.C.

(57) ABSTRACT

This invention relates to an image forming apparatus which employs a recycling scheme of recovering and reusing transfer residue toner, and a convey control method for recycle toner. In order to prevent a phenomenon such as fogging or character thickening, a toner recycle mechanism shares one driving source with a photosensitive body or fixing unit, and includes an electromagnetic clutch for switching driving force transmission to the recycling means when driving the photosensitive body or fixing unit, and a controller which controls power supply to the electromagnetic clutch. The convey control method for recycle toner includes the steps of starting copying, measuring a printing ratio of an image pattern per image, and suppressing a return amount of the recycle toner when the printing ratio of the image pattern is low.

12 Claims, 4 Drawing Sheets

IMAGE FORMING APPARATUS AND CONVEY CONTROL METHOD FOR RECYCLE TONER

BACKGROUND OF THE INVENTION

1. Field of the Invention

The present invention relates to an image forming apparatus for development by using a two-component developing agent in accordance with electrophotography and, more particularly, to an image forming apparatus which employs a recycling scheme of recovering and reusing transfer residue toner and a convey control method for recycle toner.

2. Description of the Related Art

According to an example of an image forming process of forming an image by electrophotography, an electrostatic latent image is formed on a latent image carrier such as a photosensitive body. The formed electrostatic latent image is developed by a developing means to form a toner image on the latent image carrier. The formed toner image is transferred onto transfer paper by a transfer means. The transferred toner image is fixed on the transfer paper by a fixing means. Thus, an image is formed on the transfer paper. According to another example, a toner image on an image forming body such as a photosensitive body is transferred onto an intermediate transfer body serving as an image carrier. The toner image is then transferred from the intermediate transfer body onto transfer paper by a transfer means, and is fixed. Thus, an image is formed on the transfer paper.

In the developing step of an image forming process, development using a two-component developing agent containing nonmagnetic toner and a magnetic carrier is often employed, and a DC-bias developing bias voltage is applied.

In development using the two-component developing agent, since only the toner is consumed by development, an appropriate amount of new toner corresponding to the consumed amount must be replenished. Thus, toner replenishment is performed.

The toner image formed on the latent image carrier is transferred onto the transfer paper or intermediate transfer body by the transfer means. At this time, the transfer residue toner which is not transferred but left on the latent image carrier is cleaned by a cleaning means. A recycling scheme is employed in which the toner cleaned by the cleaning means and recovered in a cleaning unit is conveyed to a developing unit and is reused. When the recycling scheme is employed, a waste toner box for collecting the recovered toner to dispose it is not necessary. In this manner, the recycling scheme can be regarded as a scheme that reduces waste and is accordingly friendly to the environment.

A dynamic torque required for conveying the toner recovered by the recycling means to the developing unit is as small as about 1/10 that required for driving the latent image carrier and fixing unit. To reduce the cost and to save the space, the recycling means is driven by the same driving source as for the latent image carrier or fixing unit.

In the cleaning unit, the toner (recycle toner) recovered by the cleaning means has been conveyed after it is scraped by a cleaning blade or the like. The recycle toner has accordingly been subjected to a mechanical stress. When the recycle toner is compared to new toner, it has lower flowability, it is harder to mix with the carrier, and its electrostatic properties also degrade. When the recycle toner is developed again, it tends to pose a problem such as fogging or character thickening. This phenomenon does not substantially pose any problem when the ratio of the recycle toner in the developing agent is low, but does when the ratio is high.

When toner having a small particle size or toner manufactured by a polymerization method and having a sharp particle size distribution is used, an image quality such as resolution, tone, character reproducibility, and the like is high. Therefore, when the recycle toner described above is used, the above problem is obvious.

This problem of degradation in image quality occurs as follows. When the printing ratio of an image formation pattern to be printed continuously is low, the amount of new toner to be replenished becomes small, and accordingly the proportion of the recycle toner in the developing agent increases. This causes obvious degradation in image quality.

It is known that the problem of degradation in image quality tends to occur when the image forming apparatus has been kept stopped for a long period of time, e.g., for 2 h or more, and then several hundred prints are output. This is because the charges of the recycle toner damaged due to the long-time stop are decreased.

To solve this phenomenon, a single driving source may be employed as a driving source for the recycling means, or the amount of recycle toner to be returned to the developing unit may be controlled in accordance with the printing ratio of an image formation pattern. Alternatively, while several hundred prints are output after long-time stop, the amount of recycle toner to be returned to the developing unit may be controlled. If, however, a single driving source is provided to the recycling means in order to control the amount of recycle toner, cost reduction and space saving cannot be achieved.

SUMMARY OF THE INVENTION

The present invention has been made in view of the above situation of the prior art, and has as its object to provide an image forming apparatus in which the supply amount of recycle toner can be controlled so that, while the recycling means shares one driving source with the latent image carrier or fixing unit, no degradation in image quality occurs even when, e.g., the printing ratio of the image formation pattern is low continuously or even in operation after long-time stop.

In order to achieve the above object, according to the first aspect of the present invention, there is provided an image forming apparatus comprising a latent image carrier for carrying a latent image, a developing unit for making visible the latent image on the latent image carrier on a developing agent carrier carrying a developing agent formed of nonmagnetic toner and a magnetic carrier, a transfer unit for transferring a visible image on the latent image carrier onto transfer paper, a fixing unit for fixing the toner on the transfer paper, a cleaning unit arranged downstream of the transfer unit to clean the nonmagnetic toner on the latent image carrier, recycling means for conveying the cleaned toner to the developing unit, and control means, wherein the recycling means shares one driving source with the latent image carrier, and comprises an electromagnetic clutch for switching driving force transmission to the recycling means when driving the latent image carrier, and the control means controls power supply to the electromagnetic clutch.

According to the second aspect of the present invention, there is provided an image forming apparatus comprising a latent image carrier for carrying a latent image, a developing unit for making visible the latent image on the latent image carrier on a developing agent carrier carrying a developing agent formed of nonmagnetic toner and a magnetic carrier, a transfer unit for transferring a visible image on the latent image carrier onto transfer paper, a fixing unit for fixing the toner on the transfer paper, a cleaning unit arranged downstream of the transfer unit to clean the nonmagnetic toner on the latent image carrier, recycling means for conveying the cleaned toner to the developing unit, and control means, wherein the recycling means shares one driving source with the fixing unit, and comprises an electromagnetic clutch for switching driving force transmission to the recycling means when driving the fixing unit, and the control means controls power supply to the electromagnetic clutch.

The electromagnetic clutch in the image forming apparatus according to the first and second aspects transmits a driving force in an OFF state and does not in an ON state.

Power supply to the electromagnetic clutch in the image forming apparatus according to the first and second aspects is controlled such that the lower a printing ratio of an image formation pattern, the longer an ON time.

Power supply to the electromagnetic clutch in the image forming apparatus according to the first and second aspects is controlled in accordance with a time since the apparatus is stopped until driving of the apparatus is resumed.

The recycling scheme is very excellent in that it does not dispose, as waste toner, toner which is not transferred but recovered, and reuses it. As is apparent from the above aspects, with the image forming apparatus of the present invention, the problem of how the recycling means should be driven and the problem of the phenomenon in which fogging or character thickening occurs during development due to the recycle toner containing damaged toner can be solved without sacrificing the cost or space, while an image with a high image quality can be maintained for a long period of time.

The above and many other objects, features and advantages of the present invention will become manifest to those skilled in the art upon making reference to the following detailed description and accompanying drawings in which preferred embodiments incorporating the principle of the present invention are shown by way of illustrative examples.

DETAILED DESCRIPTION OF THE PREFERRED EMBODIMENTS

Several preferred practical examples and embodiments of an image forming apparatus according to the present invention will be described with reference to the accompanying drawings.

Figure 1:
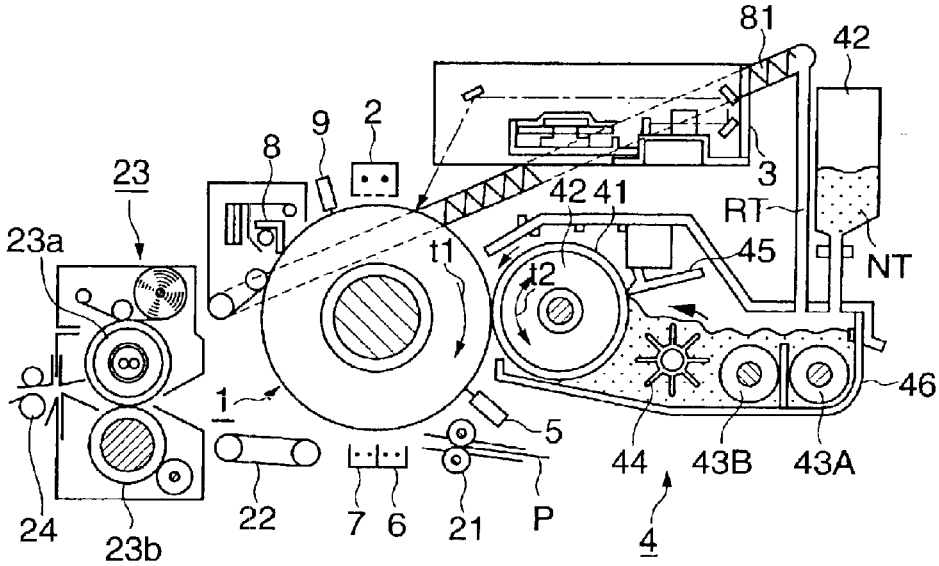
FIG. 1 is a longitudinal sectional view showing the arrangement of an image forming apparatus.

FIG. 1 shows a copying machine that utilizes the electrophotographic process of forming a monochrome image as an image forming apparatus to which the present invention is applied. Note that the image forming apparatus of the present invention is not limited to the arrangement shown in FIG. 1.

Reference numeral 1 denotes a drum-like photosensitive body serving as a latent image carrier. In the photosensitive body 1, as an organic semiconductor layer to be negatively charged, a phthalocyanine pigment dispersed in polycarbonate is applied to a cylinder-like metal substrate which is grounded. The thickness of the photosensitive body layer including a charge transport layer is 30 $\mu$m. The drum has a diameter of 80 mm, and is rotatably driven at a peripheral velocity (Vp) of 280 mm/s in the direction of an arrow (t1).

Reference numeral 2 denotes a scorotron charging means for uniformly charging the outer surface of the rotating photosensitive body 1 to a predetermined polarity and potential. The charging means 2 forms a charging electrode arrangement in which the distance between the wire and grid is 7.5 mm, the distance between the grid and photosensitive body is 1 mm, and the distance between the wire and back plate is 12 mm. The charging means 2 applies a bias voltage to the photosensitive body 1 with a grid application voltage of −730 V and a charging current value of −800 $\mu$A, thus setting the charging potential of the photosensitive body 1 to −750 V.

Reference numeral 3 denotes an image exposing means employing a laser scanning scheme. The image exposing means 3 uses a semiconductor laser (LD) having a laser wavelength of 780 nm, and its output power is 300 $\mu$W. The image exposing means 3 emits a laser beam to scan and expose the uniformly charged surface of the photosensitive body 1, thus forming an electrostatic latent image.

A developing unit 4 has a magnet roller 42 as a developing stationary magnet in it. A developing agent in which toner is attached to the carrier charged by mutual friction is attached to the outer surface of a developing agent carrier 41 rotatable in the direction indicated by an arrow (t2). After the thickness of the developing agent is regulated by a layer thickness regulating means 45, the developing agent is conveyed to a developing region opposing the photosensitive body 1. Then, development is performed.

A pair of stirring convey screws 43A and 43B and a rotary paddle 44 are provided in a developing container 46, and convey toner NT newly supplied from a toner hopper 42 or recycle toner RT to the developing agent carrier 41 while mixing them with the developing agent in the container 46 and stirring them. The stirring convey screws 43A and 43B are both rod-like screw members, of which one stirs the developing agent from the front side to the deep side of the surface of drawing, and the other one from the deep side to the front side, thus conveying the developing agent. The toners NT and RT are dropped onto the developing agent which is being circulated by the stirring convey screws 43A and 43B, so that they are mixed and stirred and discharged toward the rotary paddle 44. The developing agent mixed with the discharged toners NT and RT and stirred is further stirred by the rotary paddle 44 which is like a water wheel, and is supplied to the developing agent carrier 41. The developing agent carrier 41 is formed by covering the outer surface of a magnet roller with an aluminum sleeve having a surface coated with stainless steel by flame spray coating. The developing agent carrier 41 having a roller diameter of 40 mm is rotated at a linear velocity (vs) of 560 mm/s, so that its linear-velocity ratio (vs/vp) to the photosensitive body 1 is 2. The developing agent carrier 41 performs development upon reception of a DC-component developing bias. Reverse development is performed by applying a developing bias of −600 V as the DC component.

As the toner of the two-component developing agent containing the nonmagnetic toner and magnetic carrier, polymerized toner having a volume average particle size of 3 μm to 9 μm is preferable. When polymerized toner is used, an image forming apparatus with high resolution and stable density, which causes very few fogging becomes possible.

The polymerized toner is manufactured by the following manufacturing method.

A toner binder resin is produced and its toner shape is formed by polymerization of a material monomer or prepolymer for the binder resin and a subsequent chemical process. More specifically, the toner binder resin is obtained by polymerization reaction such as suspension polymerization or emulsion polymerization, and a subsequent particle fusing step which is performed when necessary. Regarding the polymerized toner, the material monomer or prepolymer is uniformly dispersed in a water system and is thereafter polymerized, thus manufacturing the toner. As a result, spherical toner having a uniform particle size distribution and uniform shape can be obtained.

A shape factor SF-1 indicating the spherical degree of the toner is preferably between 100 and 140, and a shape factor SF-2 indicating the degree of non-uniformity of the toner is preferably between 100 and 120. The shape factors SF-1 and SF-2 are given by the following equations:

$$\text{SF-1}=(L\max^2/A)\times(\pi/4)\times 100$$

$$\text{SF-2}=(L\text{around}^2/A)\times(1/4\pi)\times 100$$

where Lmax is the maximum diameter, Laround is the circumferential length, and A is the toner projection area.

When the volume average particle size of the toner becomes less than 3 μm, fogging or toner scattering tends to occur. The upper limit of 9 μm is the upper limit of the particle size that enables high image quality that this embodiment is aimed at.

As the carrier, a ferrite core carrier formed of magnetic particles with a volume average particle size of 30 μm to 65 μm and a magnetization amount of 20 emu/g to 70 emu/g in saturation magnetization is preferable. With a carrier having a particle size smaller than 30 μm, carrier attaching tends to occur. With a carrier having a particle size larger than 65 μm, an image with a uniform density may not be formed.

Reference numeral 5 denotes a pre-transfer exposure light source for irradiating the toner image in order to improve its transfer performance. Irradiation is performed with an LED having a light wavelength of 700 nm at a light output of 10 lux.

Reference numeral 6 denotes a corotron transfer electrode. With the transfer electrode 6, the distance between the wire and photosensitive body 1 is 8 mm and the distance between the wire and back plate is 12 mm. The transfer electrode 6 transfers the toner image on the photosensitive body 1 onto the transfer paper by constant current control with a transfer current of 200 μA.

Reference numeral 7 denotes a corotron separation electrode. with the separation electrode 7, the distance between the wire and photosensitive body 1 is 8 mm and the distance between the wire and back plate is 12 mm. The separation electrode 7 promotes separation of the transfer paper from the photosensitive body 1 by a separation current with an AC component of 1,000 μA and a DC component of −200 μA.

Transfer paper P supplied from a paper supply unit (not shown) is supplied by registration rollers 21 in synchronism with the toner image formed on the photosensitive body 1, and the toner image is transferred to it at a transfer nip portion (not shown) by the transfer electrode 6. The transfer paper P passing through the transfer nip portion is separated from the surface of the photosensitive body 1 by the separation electrode 7, and is conveyed to a fixing unit 23 by a conveyor belt 22.

The fixing unit 23 consists of a heat roller 23*a* incorporating a heater, and a press roller 23*b*. The transfer paper P bearing the toner image on its surface is heated and pressurized between the heat roller 23*a* and press roller 23*b*, so that the toner image is fixed. The transfer paper P to which the toner image is fixed is delivered by delivery rollers 24 onto a delivery tray outside the copying machine.

The surface of the photosensitive body 1, from which the toner image has been transferred to the transfer paper P, is cleaned by a cleaning unit 8 to remove the transfer residue toner. In this embodiment, a blade made of urethane rubber is used as the cleaning means. The cleaning blade is of a counter type which comes into slidable contact with the outer surface of the photosensitive body 1 to clean it. The outer surface of the photosensitive body 1, which has been cleaned while passing through the cleaning unit 8, is irradiated by a pre-charging exposing (PCL) means 9 using a light source having a light wavelength of 700 nm and a light output of 10 lux, so the residual potential is decreased. After that, the process moves to the next image formation cycle.

The toner recovered by the cleaning unit 8 is dropped onto the bottom of the cleaning unit 8 having a capacity of, e.g., about 100 g. The recovered toner collected at the bottom of the cleaning unit 8 is recovered in the developing unit 4 by a toner recycling means (unit) 81 which conveys the toner by rotation of a convey screw provided in a toner convey path (to be described later), and is reused as recycle toner for development.

In the image forming apparatus of the present invention described above, the toner recycling means 81 is driven by the same driving source as that for driving the photosensitive body 1 or fixing unit 23.

Figure 2:
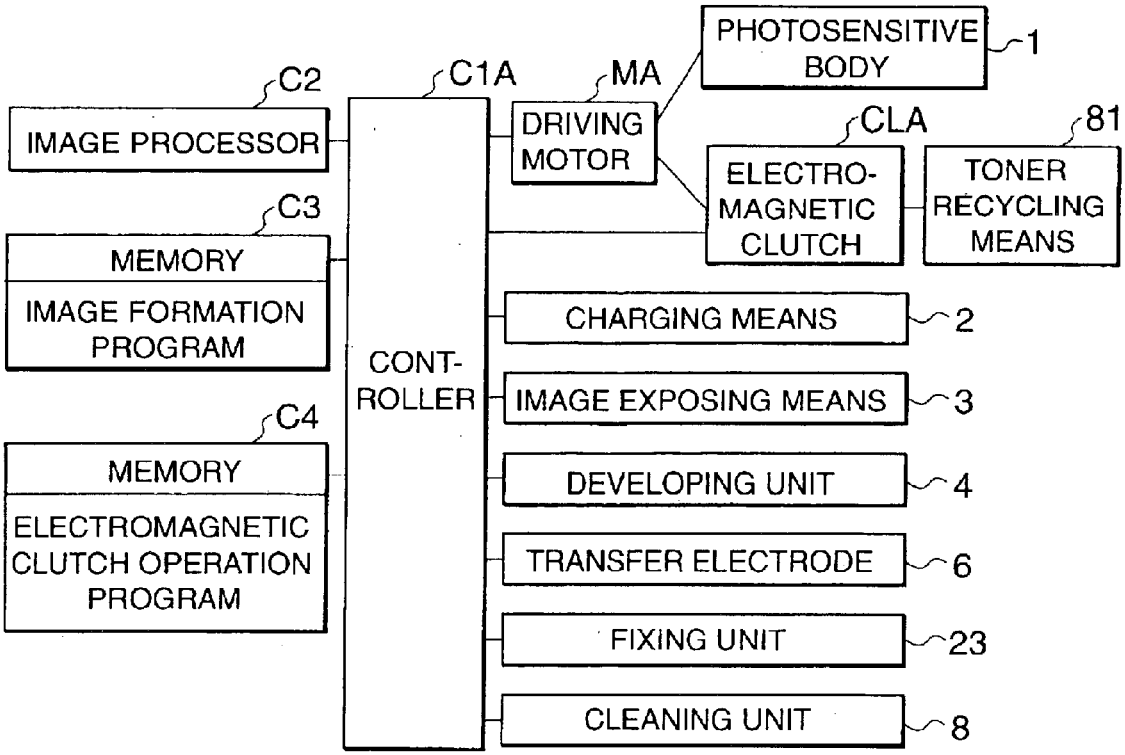
FIG. 2 is a control block diagram of the image forming apparatus.

FIG. 2 is a control block diagram of an image forming apparatus in which the toner recycling means 81 is driven by the same driving motor MA as for the photosensitive body 1.

In a controller C1A, the return amount of the recycle toner is controlled appropriately by an electromagnetic clutch CLA so as to suppress occurrence of a problem such as fogging or character thickening caused by the recycle toner. When it is detected that the above problem can be caused easily because the printing ratio of the image pattern is low or the apparatus has been stopped for a long period of time, the controller C1A calls an electromagnetic clutch operation program stored in a memory C4 to cope with these situations and turns on/off the electromagnetic clutch CLA. Thus, the return amount of the recycle toner is suppressed.

The recycle toner to be recovered by the cleaning unit 8 occurs in accordance with the apparatus driving time during image formation, and must accordingly be basically returned to the developing unit 4 in accordance with the driving operation of the apparatus. For this purpose, as the electromagnetic clutch CLA used for driving the toner recycling means 81, one which performs driving when it is OFF to convey the recycle toner and which stops driving when it is ON to stop conveying the recycle toner, that is, a normally closed electromagnetic clutch is used.

Figure 3:
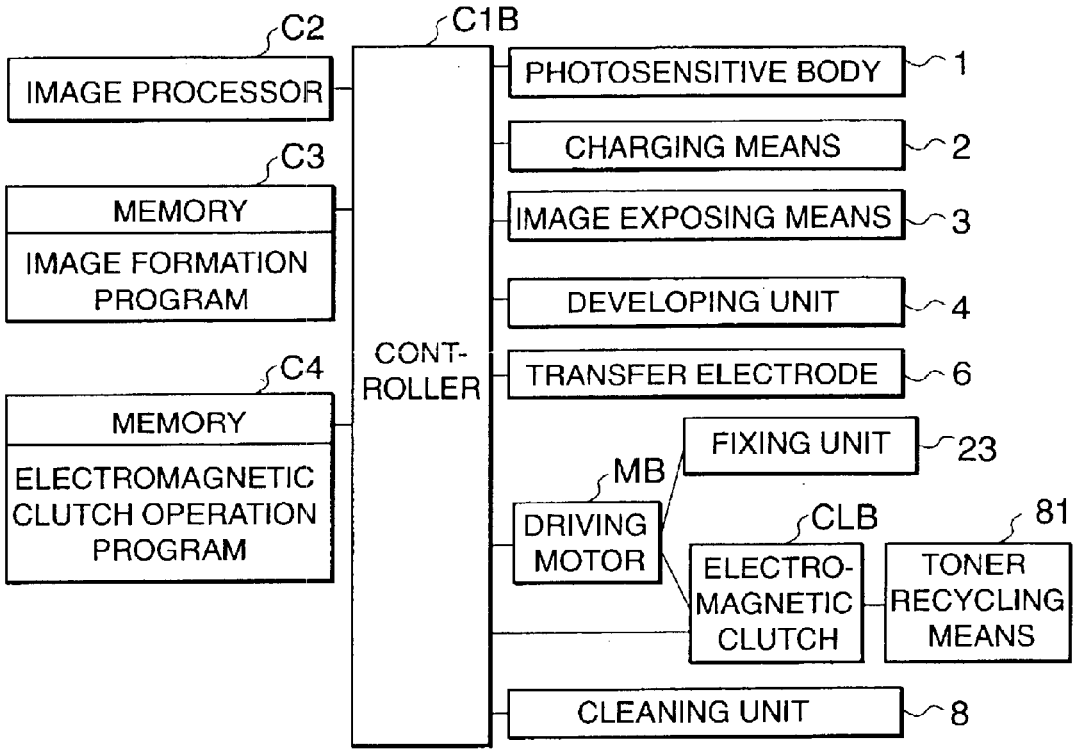
FIG. 3 is a control block diagram of the image forming apparatus.

FIG. 3 is a control block diagram of an image forming apparatus in which the toner recycling means 81 is driven by the same driving motor MB as for the fixing unit 23.

In a controller C1B, the return amount of the recycle toner is controlled appropriately by an electromagnetic clutch CLB so as to suppress occurrence of a problem such as fogging or character thickening caused by the recycle toner. When it is detected that the above problem can be caused easily because the printing ratio of the image pattern is low or the apparatus has been stopped for a long period of time, the controller C1B calls an electromagnetic clutch operation program stored in the memory C4 to cope with these situations and turns on/off the electromagnetic clutch CLB. Thus, the return amount of the recycle toner is suppressed.

The recycle toner to be recovered by the cleaning unit 8 is produced with the lapse of the apparatus driving time during image formation, and must accordingly be basically returned to the developing unit 4 in accordance with the driving operation of the apparatus. For this purpose, as the electromagnetic clutch CLB used for driving the toner recycling means 81, one which performs driving when it is OFF to convey the recycle toner and which stops driving when it is ON to stop conveying the recycle toner, that is, a normally closed electromagnetic clutch is used.

Preferred operation examples of the present invention will be described. Many types of programs are available by combining electromagnetic clutch operation programs stored in the memory C4 described in the control block diagrams of FIGS. 2 and 3, or by changing the threshold, and many operation examples are available. Three operation examples will now be described.

OPERATION EXAMPLE 1

Figure 4:
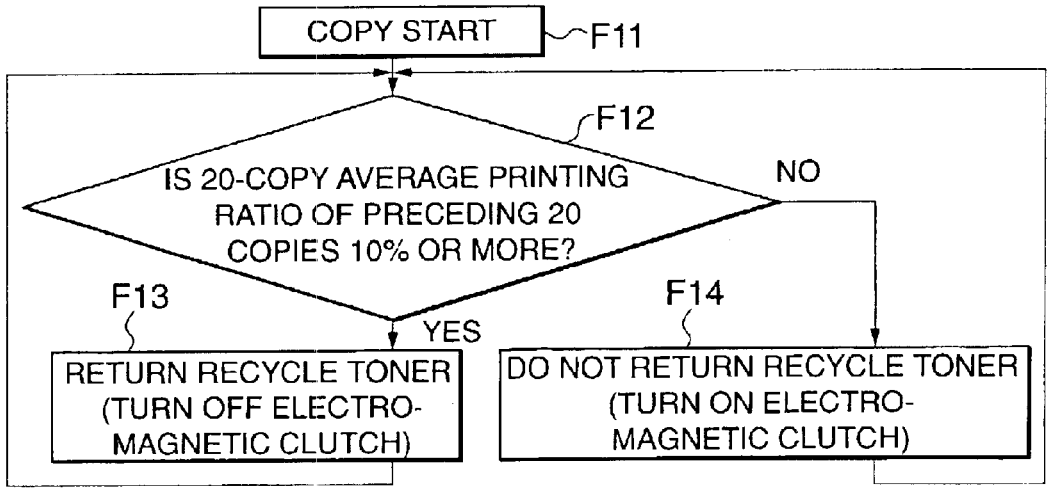
FIG. 4 is a flow chart of the first embodiment.

According to convey control for the recycle toner to be described in operation example 1, control operation is performed to suppress the return amount of the recycle toner when the printing ratio of the image pattern is low. FIG. 4 shows a flow chart of this control.

In an image processor C2, when image data is to be subjected to image processes such as tone correction, the printing ratio of an image pattern: per image is measured and is stored in the memory.

When copying is started (F11), the controller C1A (C1B) calculates a 20-copy average printing ratio of preceding 20 copies stored in the memory, and checks whether the obtained average printing ratio is 10% (as a low printing ratio) or more (F12).

If the average printing ratio of the 20 copies is 10% or more, the electromagnetic clutch CLA (CLB) maintains OFF, and transmits the driving force to return the recycle toner to the developing unit 4 (F13).

If the average printing ratio of the 20 copies is less than 10%, the electromagnetic clutch CLA (CLB) is turned on and does not transmit the driving force, so the recycle toner is not returned to the developing unit 4 (F14).

When copy operations including many image patterns with low printing ratios are to be performed continuously by continuously performing the above control operation while shifting it every copy operation, return of the recycle toner to the developing unit 4 is suppressed, and the problem such as fogging or character thickening does not occur in the printed image.

OPERATION EXAMPLE 2

Figure 5:
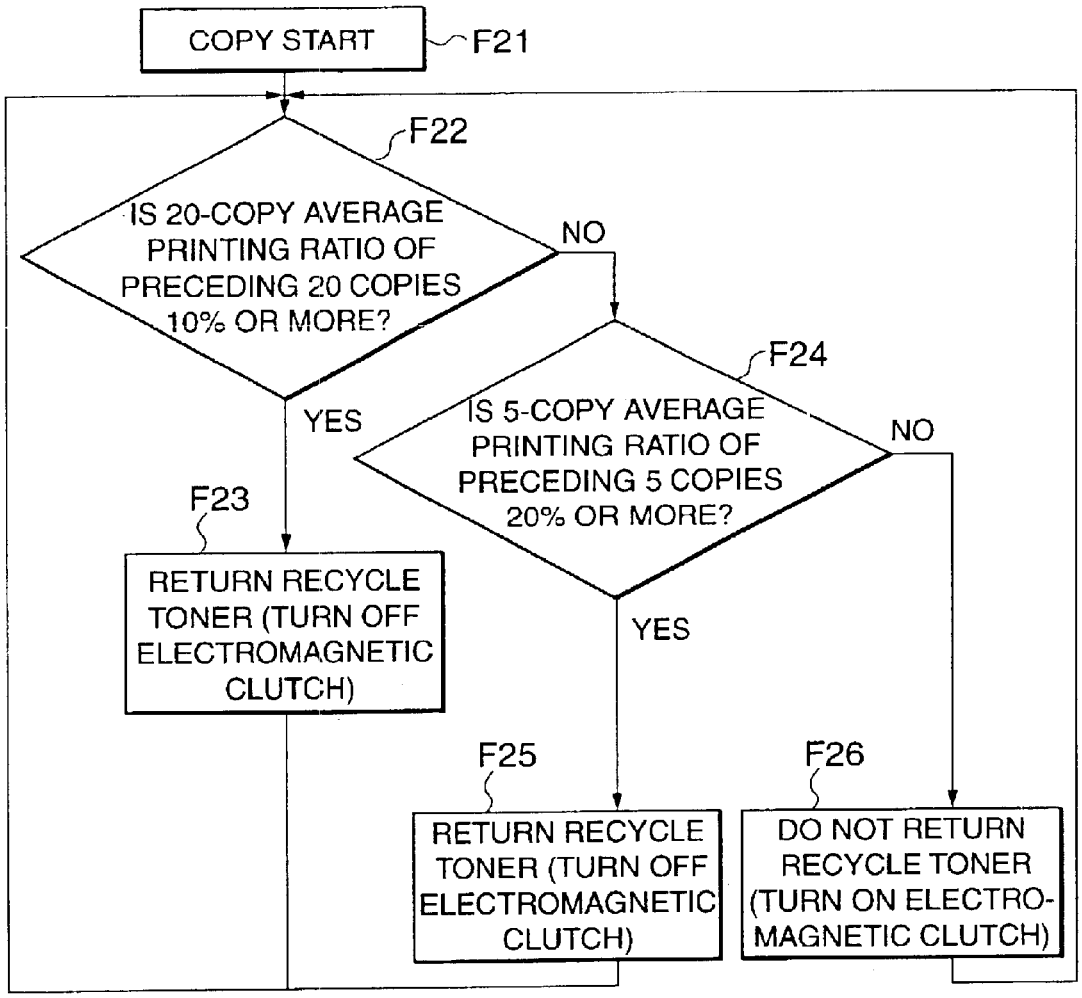
FIG. 5 is a flow chart of the second embodiment.

In the flow of operation example 1, when the space in the cleaning unit 8 for storing the recovery toner recovered by the cleaning means is small, the recovery toner which is not conveyed but left may fill the cleaning unit 8 to overflow. Hence, when an image pattern with a high printing ratio with which a large amount of recovery toner may be produced is to be output, the electromagnetic clutch CLA (CLB) is controlled to perform recycling in combination with the flow of operation example 1. This is operation example 2. FIG. 5 shows a flow chart of this control.

In the image processor C2, when an image data process is to be performed, the printing ratio of an image pattern per image is measured and is stored in the memory.

When copying is started (F21), the controller C1A (C1B) calculates a 20-copy average printing ratio of preceding 20 copies stored in the memory, and checks whether the obtained printing ratio is 10% (as a low printing ratio) or more (F22).

If the average printing ratio of the 20 copies is 10% or more, the electromagnetic clutch CLA (CLB) maintains OFF, and transmits the driving force to return the recycle toner to the developing unit 4 (F23).

If the average printing ratio of the 20 copies is less than 10%, whether a 5-copy average printing ratio of preceding 5 copies is 20% (as a high printing ratio) or more, is checked (F24).

If the 5-copy average printing ratio is 20% or more, that is, if the image currently being printed has a high printing ratio and new toner is being replenished, the electromagnetic clutch CLA (CLB) is turned off, and transmits a driving force to return the recycle toner to the developing unit 4 (F25).

If the 5-copy average printing ratio is less than 20%, the electromagnetic clutch CLA(CLB) is turned on and does not transmit the driving force, so the recycle toner is not returned to the developing unit 4 (F26).

When copy operations including many image patterns with low printing ratios are to be performed continuously by continuously performing the above control operation while shifting it every copy operation, return of the recycle toner to the developing unit 4 is suppressed. If an image pattern with a high printing ratio mixes in the continuous copy operations, control operation is performed to return the recycle toner, so that an appropriate recycle operation is performed. Thus, the recycle toner does not excessively accumulate in the cleaning unit, and the problem such as fogging or character thickening does not occur in the printed image.

OPERATION EXAMPLE 3

Figure 6:
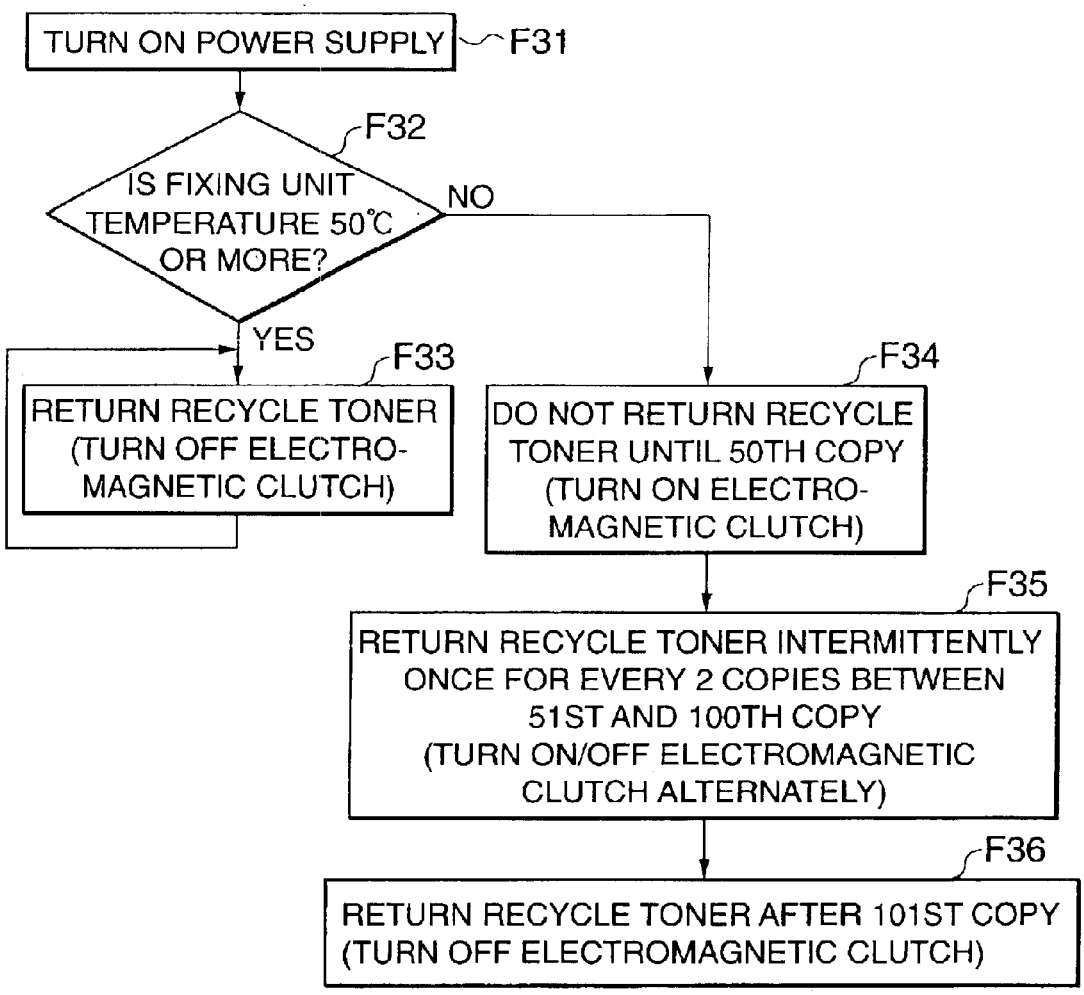
FIG. 6 is a flow chart of the third embodiment.

When the image forming apparatus resumes operation after it has been stopped for a long period of time, an inconvenience such as fogging or character thickening tends to occur in the print image while several hundred copies are output. According to operation example 3, the amount of recycle toner to be returned to the developing unit 4 is controlled while the several hundred copies are output after the long-time stop. FIG. 6 shows a flow chart of this control.

The fixing unit 23 has a temperature sensor for measuring the temperature of the fixing unit 23. When the power supply is turned on (F31), the controller C1A (C1B) checks whether the fixing unit temperature detected by the temperature sensor is 50° C. or more (F32).

If the fixing unit temperature is 50° C. or more, that is, if the stop time since the last copy is output is not very long, the electromagnetic clutch CLA (CLB) is turned off to transmit the driving force, and the recycle toner is returned to the developing unit 4 (F33).

If the fixing unit temperature is less than 50° C., that is, after the copying machine is stopped for a long period of time, the electromagnetic clutch CLA (CLB) is kept on until 50 copies are output since the resumption of operation and does not transmit the driving force, so the recycle toner is not returned to the developing unit 4 (F34).

Between 51st and 100th copies, the electromagnetic clutch CLA (CLB) is turned on and off alternately for each print, and returns the recycle toner to the developing unit 4 intermittently with a ½ convey time once for every 2 copies (F35).

After 101 copies, the electromagnetic clutch CLA (CLB) maintains OFF and transmits the driving force to return the recycle toner to the developing unit 4.

When the above control operation is performed, even after the image forming apparatus is stopped for a long period of time, an inconvenience such as fogging or character thickening does not occur in the print image. Flows F33 and F36 of this example may be replaced by the flow chart shown in FIG. 5 described in example 2. Then, control operation free from a phenomenon such as fogging or character thickening is performed both in image formation after the image forming apparatus is stopped for a long period of time and in image formation including many image patterns with low printing ratios.

In the practical examples described above, a case wherein the recycling means shares one driving source with the latent image carrier and a case wherein the recycling means shares one driving source with the fixing unit are described. Note that the recycling means can share one driving source with the developing unit or with the registration rollers of the sheet feed means. In such driving arrangement, if the electromagnetic clutch described above is provided and control operation is performed, the same effect as that described above can be obtained.

What is claimed is:

1. An image forming apparatus comprising:

a latent image carrier for carrying a latent image;

a developing unit for developing the latent image carried on said latent image carrier on a developing agent carrier which carries a developing agent formed of nonmagnetic toner and a magnetic carrier;

a transfer unit for transferring a developing image on said latent image carrier onto a transfer paper;

a fixing unit for fixing the toner on the transfer paper;

a cleaning unit arranged downstream of said transfer unit to recover the nonmagnetic toner on said latent image carrier; and a recycling unit which conveys the toner recovered by the cleaning unit to said developing unit, and which shares one driving source with said latent image carrier;

wherein said recycling unit comprises;

an electromagnetic clutch for transmitting a driving force to said recycling unit when driving said latent image carrier; and a controller for controlling power supply to said electromagnetic clutch;

wherein said electromagnetic clutch comprises a normally closed electromagnetic clutch which transmits the driving force in an OFF state thereof and which does not transmit the driving force in an ON state thereof.

2. The image forming apparatus according to claim 1, wherein the power supply to said electromagnetic clutch is controlled such that a time that the electromagnetic clutch is maintained in the ON state is longer for lower printing ratios of an image formation pattern.

3. The image forming apparatus according to claim 1, wherein power supply to said electromagnetic clutch is controlled based on a length of time from when said apparatus is stopped until driving of said apparatus is resumed.

4. The image forming apparatus according to claim 1, wherein the nonmagnetic toner is polymerized toner having a volume average particle size which is not less than 3 $\mu$m and not more than 9 $\mu$m.

5. The image forming apparatus according to claim 4, wherein a shape factor SF-1 indicating a spherical degree of the nonmagnetic toner is 100 to 140, and a shape factor SF-2 indicating a degree of non-uniformity of the nonmagnetic toner is 100 to 120;

wherein $$\text{SF-1}=(L\max^2/A)\times(\pi/4)\times 100;\ \text{and}$$

$$\text{SF-2}=(L\text{around}^2/A)\times(1/4\pi)\times 100$$

where:

Lmax is the maximum particle diameter;

Laround is the particle circumferential length, and

A is the toner projection area.

6. The image forming apparatus according to claim 1, wherein the magnetic carrier is a ferrite core carrier formed of magnetic particles with a volume average particle size of 30 $\mu$m to 65 $\mu$m and a magnetization amount of 20 emu/g to 70 emu/g.

7. An image forming apparatus comprising:

a latent image carrier for carrying a latent image;

a developing unit for developing the latent image carried on said latent image carrier on a developing agent carrier which carries a developing agent formed of nonmagnetic toner and a magnetic carrier;

a transfer unit for transferring a developing image on said latent image carrier onto a transfer paper;

a fixing unit for fixing the toner on the transfer paper;

a cleaning unit arranged downstream of said transfer unit to recover the nonmagnetic toner on said latent image carrier; and a recycling unit which conveys the toner recovered by the cleaning unit to said developing unit, and which shares one driving source with said fixing unit;

wherein said recycling means comprises:

an electromagnetic clutch for transmitting a driving force to said recycling unit when driving said fixing unit; and a controller for controlling power supply to said electromagnetic clutch;

wherein said electromagnetic clutch comprises a normally closed electromagnetic clutch which transmits the driving force in an OFF state thereof and which does not transmit the driving force in an ON state thereof.

8. The image forming apparatus according to claim 7, wherein the power supply to said electromagnetic clutch is controlled such that a time that the electromagnetic clutch is maintained in the ON state is longer for lower printing ratios of an image formation pattern.

9. The image forming apparatus according to claim 7, wherein power supply to said electromagnetic clutch is controlled based on a length of time from when said apparatus is stopped until driving of said apparatus is resumed.

10. The image forming apparatus according to claim 7, wherein the nonmagnetic toner is polymerized toner having a volume average particle size which is not less than 3 $\mu$m and not more than 9 $\mu$m.

11. The image forming apparatus according to claim 10, wherein a shape factor SF-1 indicating a spherical degree of the nonmagnetic toner is 100 to 140, and a shape factor SF-2 indicating a degree of non-uniformity of the nonmagnetic toner is 100 to 120;

wherein:

$$\text{SF-1}=(L\max^2/A)\times(\pi/4)\times 100;\ \text{and}$$

$$\text{SF-2}=(L\text{around}^2/A)\times(1/4\pi)\times 100$$

where:

Lmax is the maximum particle diameter;

Laround is the particle circumferential length, and

A is the toner projection area.

12. The image forming apparatus according to claim 7, wherein the magnetic carrier is a ferrite core carrier formed of magnetic particles with a volume average particle size of 30 $\mu$m to 65 $\mu$m and a magnetization amount of 20 emu/g to 70 emu/g.

* * * * *